US006284063B1

(12) United States Patent
Espenhahn et al.

(10) Patent No.: US 6,284,063 B1
(45) Date of Patent: Sep. 4, 2001

(54) HOT-ROLLED STEEL STRIP AND METHOD OF MAKING IT

(75) Inventors: Manfred Espenhahn, Essen; Thomas Heller, Duisburg; Jürgen Esdohr, Alpen, all of (DE)

(73) Assignee: Thyssen Stahl AG, Duisburg (DE)

( * ) Notice: Subject to any disclaimer, the term of this patent is extended or adjusted under 35 U.S.C. 154(b) by 0 days.

(21) Appl. No.: 09/214,480

(22) PCT Filed: Jul. 4, 1997

(86) PCT No.: PCT/EP97/03541

§ 371 Date: Feb. 25, 1999

§ 102(e) Date: Feb. 25, 1999

(87) PCT Pub. No.: WO98/02589

PCT Pub. Date: Jan. 22, 1998

(30) Foreign Application Priority Data

Jul. 12, 1996 (DE) ..... 196 28 135
May 9, 1997 (DE) ..... 197 19 546

(51) Int. Cl.[7] ..... C21D 8/02; C22C 38/06
(52) U.S. Cl. ..... 148/320; 148/602
(58) Field of Search ..... 148/602, 320; 420/104

(56) References Cited

U.S. PATENT DOCUMENTS 4,406,713 9/1983 Yutori et al. .
4,437,903 3/1984 Furukawa et al. .
4,830,686 * 5/1989 Hashiguchi et al. ..... 148/320

FOREIGN PATENT DOCUMENTS 30 07 560 A1 3/1981 (DE) .
0 181 583 A2 5/1986 (EP) .
0 492 623 A1 7/1992 (EP) .
0 753 596 A1 1/1997 (EP) .
2 446 323 A 8/1980 (FR) .
2 195 658 A 4/1988 (GB) .
55-131168 * 10/1980 (JP) .
57-019322 * 2/1982 (JP) .
1-1 98 449 A1 8/1989 (JP) .
5-179359 * 7/1993 (JP) .

* cited by examiner

*Primary Examiner*—George Wyszomierski
*Assistant Examiner*—Janelle Combs-Morillo
(74) *Attorney, Agent, or Firm*—Proskauer Rose LLP

(57) ABSTRACT

The invention concerns hot-rolled steel strip no more than 5 mm thick, optionally less than 2 mm thick, made of high-tensile steel, that contains 0.08%–0.25% carbon, 1.20% to 2.0% manganese, and 0.02% to 0.05% aluminum, and optionally up to 1.0% chromium, up to 0.1% copper, up to 0.5% molybdenum, up to 0.1% nickel, up to 0.009% nitrogen, up to 0.0025% B, and optionally a stoichiometric amount of titanium in relation to nitrogen. The steel strip has a greater than 95% martensitic structure, and a tensile strength of 800 to 1400 N/mm$^2$.

13 Claims, No Drawings

HOT-ROLLED STEEL STRIP AND METHOD OF MAKING IT

The invention relates to hot strip of a maximum thickness of 5 mm, made of high-strength steel, and a process for its production. Hot strip refers to hot-rolled strip.

According to the present state of the art, hot strip is only produced to a strength of approx. 800 N/mm$^2$. These are thermo-mechanically rolled micro-alloyed steels. For applications requiring strengths in excess of this, soft hot strip is used and the required strength of the component is attained by subsequent heat treatment. For thickness ranges below 2.0 mm usually additional cold rolling is required in order to obtain the desired thickness. In this case, too, the required strength is attained by suitable heat treatment.

From U.S. Pat. No. 4,406,713 steel having high strength and high ductility with good workability is known which comprises 0.005 to 0.3% C, 0.3 to 2.5% Mn, up to 1.5% Si and at least one carbide and nitride former from the group Nb, V, Ti and Zr in quantities of up to 0.1%, to 0.15%, to 0.3% and 0.3% respectively. After austenitising, this steel is quenched to such an extent that it contains 5 to 65% ferrite, the remainder being martensite. It is intended above all for the production of wires and bars.

From GB 2 195 658 A1 forged parts from a steel with 0.01 to 0.20% C, up to 1.0% Si, 0.5 to 2.25% Mn, up to 1.5% Cr, up to 0.05% Ti, up to 0.10% Nb, 0.005 to 0.015% N and up to 0.06% Al is known. Cooling of the steel from the austenitic region is to be controlled in such a way that the microstructure is fully martensitic. To be sure, only examples with carbon contents below 0.10% and silicon contents above 0.17% are disclosed. At over 0.01%, sulphur contents are relatively high.

The steels known from EP 0 072 867 A1, too, have carbon contents below 0.10% and silicon contents above 0.15%. The hot strip, after stepped cooling, has a dual-phase microstructure of polygonal ferrite and a mixture of pearlite and bainite.

The hot strip known from DE 30 07 560 A1, after hot rolling, too, is cooled at a cooling rate of 1 K/s or faster in order to produce a dual-phase microstructure of ferrite and martensite. In view of satisfactory properties regarding ductility and weldability, carbon contents in the range of 0.02 to 0.09% are recommended. The preferred silicon content is relatively high at 1.0%.

It is the objective of the invention to produce a hot strip with values of tensile strength in excess of 800 N/mm$^2$ and at the same time with good ability to be cold-reduced in the thickness range <5 mm. This would mean an enlargement of the direct use of hot strip for cold-reduction purposes, such as cold pressing, with significant economic advantages arising from the fact that cold rolling and treatment would be done without.

This object is met according to the invention by a proposed hot strip with a thickness below 5 mm, in particular below 2 mm, with a tensile strength of 800 to 1400 N/mm$^2$, from a steel with the following composition (in mass %):

| | |
|---|---|
| 0.08 to 0.25% | carbon, |
| 1.20 to 2.0% | manganese, |
| 0.02 to 0.05% | aluminium |
| less than 0.07% | silicon, |

the remainder being iron and unavoidable impurities, including up to 0.015% phosphorus and up to 0.003% sulphur, and martensitic structure with less than 5% in total of other structural components.

If desired, the steel may additionally contain at least one of the following elements in mass %:

| | |
|---|---|
| up to 1.0% | chromium, |
| up to 0.1% | copper, |
| up to 0.5% | molybdenum |
| up to 0.1% | nickel, |
| up to 0.009% | nitrogen. |

Carbon may preferably be contained from 0.08 to 0.15%, manganese from 1.75 to 1.90%, chromium from 0.5 to 0.6% and nitrogen from 0.005 to 0.009%.

For stoichiometric setting of the nitrogen present in the steel, titanium (Ti=3.4% N) may be added in adequate quantity in order to protect an additive of up to 0.0025% B from binding to N, so that it may contribute to increased mechanical strength and the ability to be through-hardened.

Limiting the silicon content to below 0.04% adds to improved surface condition.

A process for producing hot strip with a final thickness of less than 5 mm, in particular less than 2 mm, from a steel of the claimed composition with values of tensile strength above 800 N/mm$^2$ comprises the following measures:

A slab is heated to 1000 to 1300° C., pre-rolled within the temperature range of 950 to 1150° C. and finished at a final rolling temperature above Ar3. The hot strip produced in this way is cooled down to a reel temperature in the range of 20° C. to below the martensite coiling temperature for conversion into martensitic structure with a total content of other structural components of less than 5%, and is then coiled.

Preferably, the cooling of the final rolling temperature to coiling temperature takes place with t 8/5=less than 10 S.

(t 8/5=cooling time from 800° C. to 500° C.)

The Ar3 temperature can be estimated by means of the following formula:

$$Ar3=910-310x(\%C)-80x(\%Mn)-20x(\%Cu)-15x(\%Cr)-55x(\%Ni)-80x(\%Mo)$$

The martensite start temperature Ms can be estimated by means of the following formula:

$$Ms=500-300x(\%C)-33x(\%Mn)-22x(\%Cr)-17x(\%Ni)-11x(\%Si)-11x(\%Mo)$$

By the respective choice of the coiling temperature within the above-mentioned temperature range, the tensile strength of the hot strip is preferably set to a value in the range from 800 to 1400 N/mm$^2$.

The hot strip may be galvanised to become more corrosion-resistant. High-tensile galvanised sheeting with a good ability to be cold-reduced is preferably used for highly-stressed mechanical parts in automotive construction, e.g. for lateral impact bearers and bumpers.

The steel according to the invention attains high mechanical strength without expensive alloy elements and without annealing as is the case with known steels.

The invention is illustrated by means of the following examples.

Example 1

A steel containing 0.15% C, 0.01% Si, 1.77% Mn, 0.014% P, 0.003% S, 0.028% Al, 0.0043% N, 0.526% Cr, 0.017% Cu, 0.003% Mo, 0.027% Ni, the remainder being Fe, was cast into a slab. The slab was heated to approx. 1250° C., pre-rolled at approx. 1120° C. and at a final temperature of 840° C. was rolled to a final thickness of 2 mm. Then it was cooled down and coiled up at 50° C. This results in a microstructure with more than 95% martensite.

The yield point reached values of 1120 N/mm$^2$ and the tensile strength values of 1350 N/mm$^2$ at elongation values $A_{80}$ up to 11.1%.

Example 2

A steel of the same analysis as in example 1 was processed to hot strip with a thickness of 3.5 mm. The data are shown in Table 1. The values relating to mechanical strength are significantly higher if coiling takes place at up to 95° C., instead of at over 400° C.

TABLE 1

| Sample | Final rolling temperature ° C. | Coiling temperature ° C. | $Rp_{0.2}$ N/mm$^2$ | Rm N/mm$^2$ |
|---|---|---|---|---|
| 1 | 845 | 95 | 940 | 1243 |
| 2 | 845 | 95 | 997 | 1305 |
| 3 | 845 | 95 | 983 | 1199 |
| 4* | 850 | 420 | 742 | 803 |
| 5* | 850 | 420 | 691 | 793 |
| 6* | 850 | 420 | 641 | 741 |
| 7 | 845 | 95 | 916 | 1089 |
| 8 | 845 | 95 | 1037 | 1293 |
| 9 | 845 | 95 | 1073 | 1328 |
| 10* | 835 | 455 | 672 | 768 |
| 11* | 835 | 455 | 643 | 760 |
| 12* | 835 | 455 | 676 | 778 |

*Comparative examples

Prior to cold reducing to the final form, the hot strip may be galvanised. The heat treatment cycle during galvanising the martensite in tempered. Starting from a hot strip with tensile strengths between 1200 to 1400 N/mm$^2$, depending on the heat treatment cycle during galvanising, tensile strengths of between 800 and 1100 N/mm$^2$ are obtained.

Example 3

A hot strip of 2.0 and 1.6 mm thickness was galvanised. Table 2 below shows a comparison of properties at the rolling stage and after galvanising.

TABLE 2

| | Rolling stage | | | After galvanising | | |
|---|---|---|---|---|---|---|
| Thickness mm | Re N/mm$^2$ | Rm N/mm$^2$ | A80 % | Re N/mm$^2$ | Rm N/mm$^2$ | A80 % |
| 1.6 | 1052 | 1393 | 5.7 | 1065 | 1095 | 7 |
| 1.6 | 1048 | 1387 | 7.6 | 1040 | 1082 | 5.5 |
| 2.0 | 1098 | 1361 | 6.6 | 1058 | 1082 | 5.9 |

Example 4

Hot strip of 1.6 and 1.8 mm thickness was produced as described in example 1. The production parameters and the mechanical properties determined are listed in Table 3 which also contains the chemical composition of the material examined.

Example 5

Table 4 lists the respective data for hot strip with a thickness of 1.4 mm.

TABLE 3

| Chemical composition (%) | | | | | | | | | | |
|---|---|---|---|---|---|---|---|---|---|---|
| C | Si | Mn | P | S | Al | N | Cr | Cu | Mo | Ni |
| 0.15 | 0.01 | 1.77 | 0.014 | 0.003 | 0.028 | 0.0042 | 0.526 | 0.017 | 0.003 | 0.027 |

| Thick- | Rolling conditions | | | | Tensile test: longitudinal | | | | | | Tensile test: lateral | | | | | |
|---|---|---|---|---|---|---|---|---|---|---|---|---|---|---|---|---|
| ness mm | V2 ° C. | F1 ° C. | Et ° C. | HT ° C. | Rp0.2 N/mm$^2$ | Rm N/mm$^2$ | Rp0.2/ Rm | A80 (%) | Ag1 (%) | A80 × Rm | Rp0.2 N/mm$^2$ | Rm N/mm$^2$ | Rp0.2/ Rm | A80 (%) | Ag1 (%) | A80 × Rm |
| 1.8 | 1125 | 900 | 845 | 200 | 1054 | 1376 | 0.77 | 6.5 | 3.1 | 8944 | 1033 | 1342 | 0.77 | 5.1 | 2.4 | 6844 |
| 1.8* | 1110 | 1035 | 850 | approx. | 485 | 633 | 0.77 | 15.9 | 8.5 | 10064 | 459 | 632 | 0.73 | 17.2 | 9.7 | 10870 |
| 1.6 | 1130 | 900 | 845 | 110 | 1052 | 1393 | 0.76 | 5.7 | 2.9 | 7940 | 995 | 1306 | 0.76 | 4.5 | 1.5 | 5877 |
| 1.6 | 1110 | 1020 | 840 | approx. 200 | 1024 | 1392 | 0.74 | 6.0 | 3.4 | 8352 | 1063 | 1399 | 0.76 | 7.1 | 3.9 | 9943 |

*Comparative example

TABLE 4

| Chemical composition (%) | | | | | | | | | | |
|---|---|---|---|---|---|---|---|---|---|---|
| C | Si | Mn | P | S | Al | N | Cr | Cu | Mo | Ni |
| 0.15 | 0.01 | 1.77 | 0.014 | 0.003 | 0.028 | 0.0042 | 0.526 | 0.017 | 0.003 | 0.027 |

| Thick- | Rolling conditions | | | Tensile test: longitudinal | | | | | | Tensile test: lateral | | | | | |
|---|---|---|---|---|---|---|---|---|---|---|---|---|---|---|---|
| ness mm | V2 ° C. | ET ° C. | HT ° C. | Rp0.2 N/mm$^2$ | Rm N/mm$^2$ | Rp0.2/ Rm | A80 (%) | Ag1 (%) | A80 × Rm | Rp0.2 N/mm$^2$ | Rm N/mm$^2$ | Rp0.2/ Rm | A80 (%) | Ag1 (%) | A80 × Rm |
| 1.4 | 1125 | 833 | approx. 350 | 877 | 962 | 0.91 | 5.0 | 2.0 | 4810 | 850 | 952 | 0.89 | 6.0 | 3.1 | 5712 |
| 1.4 | 1120 | 825 | approx. 500 | 636 | 746 | 0.85 | 11.4 | 6.1 | 8504 | 634 | 758 | 0.84 | 9.7 | 5.5 | 7353 |
| 1.4 | 1120 | 827 | approx. 60 | 1068 | 1304 | 0.82 | 6.4 | 3.3 | 8345 | 1107 | 1131 | 0.83 | 5.6 | 3.7 | 7453 |

What is claimed is:

1. A hot steel strip having a thickness below 5 mm and a tensile strength from 800 to 1400 N/mm$^2$, said hot steel strip comprising in mass percentage 0.08 to 0.25% of carbon, 1.20 to 2.0% of manganese, 0.02 to 0.05% of aluminum, and less than 0.07% silicon, the remainder being iron and unavoidable impurities, said impurities including up to 0.015% phosphorous and up to 0.003% sulfur, said hot steel strip having a greater than 95% martensitic structure.

2. The bot steel strip of claim 1, wherein said hot steel strip has a thickness of less than 2 mm.

3. The hot steel strip of claim 1, wherein said carbon content is in the range of 0.12 to 0.25%.1

4. The hot steel strip of claim 1, wherein said silicon is in an amount of less than 0.04%.

5. The hot steel strip of claim 1, wherein said hot steel strip is galvanized.

6. The hot steel strip of claim 1, wherein said hot steel strip additionally contains at least one element selected from the group consisting of in mass percentage: up to 1.0% of chromium, up to 0.1% copper, up to 0.5% molybdenum, up to 0.1% nickel and up to 0.009% nitrogen.

7. The hot steel strip of claim 6, wherein said carbon content is in the range of 0.08 to 0.15%, said manganese content is in the range of 1.75 to 1.90%, said chromium content is in the range of 0.5 to 0.6% and said nitrogen content is in the range of 0.005 to 0.009%.

8. The hot steel strip of claim 6, wherein said hot steel strip further comprises up to 0.0025% B and a stoichiometric amount of Ti in relation to the amount of N present in said hot steel strip.

9. A process for producing a hot steel strip having a final thickness of less than 5 mm and a tensile strength above 800 N/mm$^2$, wherein said hot steel strip comprises in mass percentage:

0.08 to 0.25% carbon, 1.20 to 2.0% manganese, 0.02 to 0.05% aluminum, and less than 0.07% silicon, the remainder being iron and unavoidable impurities, said impurities including up to 0.015% phosphorous and up to 0.003% sulfur, said hot steel strip having a greater than 95% martensitic structure, said process comprising the steps of: heating a slab to a temperature in the range of 1000 to 1300° C.; pre-rolling said slab within a temperature range of 950 to 1150° C.; finishing said slab at a final rolling temperature above Ar3 to produce a rolled strip; cooling the rolled strip to a coiling temperature in the range of 20° C. to below the martensite start temperature; and coiling of the thus cooled rolled strip such that a structure with more than 95% martensite is obtained.

10. The process of claim 9, wherein said hot steel strip has a final thickness of less than 2 mm.

11. The process of claim 9, wherein said cooling of the hot steel strip to a coiling temperature occurs with t 8/5<10 seconds, wherein t 8/5 is the cooling time from 800° to 500° C.

12. The process of claim 9, further comprising selecting said coiling temperature so that said hot steel strip has a tensile strength in the range of 800 to 1400 N/mm$^2$.

13. The process of claim 9, further comprising galvanizing said rolled strip prior to cooling said rolled strip.

* * * * *